United States Patent [19]

Rhyne

[11] Patent Number: 4,521,770

[45] Date of Patent: Jun. 4, 1985

[54] USE OF INVERSIONS IN THE NEAR REALTIME CONTROL OF SELECTED FUNCTIONS IN INTERACTIVE BUFFERED RASTER DISPLAYS

[75] Inventor: James R. Rhyne, Los Gatos, Calif.

[73] Assignee: International Business Machines Corporation, Armonk, N.Y.

[21] Appl. No.: 412,481

[22] Filed: Aug. 30, 1982

[51] Int. Cl.[3] ..... G09G 1/28

[52] U.S. Cl. ..... 340/703; 340/701; 340/734

[58] Field of Search ..... 340/703, 701, 707, 721, 340/723, 724, 734, 747, 799; 364/521, 522

[56] References Cited

U.S. PATENT DOCUMENTS

| | | | |
|---|---|---|---|
| 4,116,444 | 9/1978 | Mayer et al. | 340/734 |
| 4,364,037 | 12/1982 | Walker | 340/709 |
| 4,398,189 | 8/1983 | Pasierb, Jr. et al. | 340/799 |
| 4,439,760 | 3/1984 | Fleming | 340/703 |
| 4,454,593 | 6/1984 | Fleming et al. | 340/703 |
| 4,471,465 | 9/1984 | Mayer et al. | 340/701 |

OTHER PUBLICATIONS

Stillman et al., "Comparison of Hardware & Software Associative Memories in the Context of Computer Graphics", 20 CACM, 5-77, pp. 331-339.

Newman et al., "Principles of Interactive Computer Graphics", 2nd Edition, McGraw Hill, 1979, pp. 217-245; 247-289.

Foley, "Fundamentals of Interactive Computer Graphics", Addison Wesley, 1982, pp. 123-126; 466-475; 497-503.

*Primary Examiner*—Gerald L. Brigance

*Attorney, Agent, or Firm*—R. Bruce Brodie

[57] ABSTRACT

If object identity is written into pixel locations of the refresh buffer portion of a raster-driven display as objects are drawn or amended, and if such object identity is used to index color maps and tree-linked lists of multiple object displays, then editing functions, such as correlation and echoing, color mixing, and selective erasure, at the display level can be invoked and executed with a minimum of reprocessing of the display list at the host level.

7 Claims, 16 Drawing Figures

REAL CORRELATION/ECHO APPARATUS & INTERACTIVE CONTROL FLOW

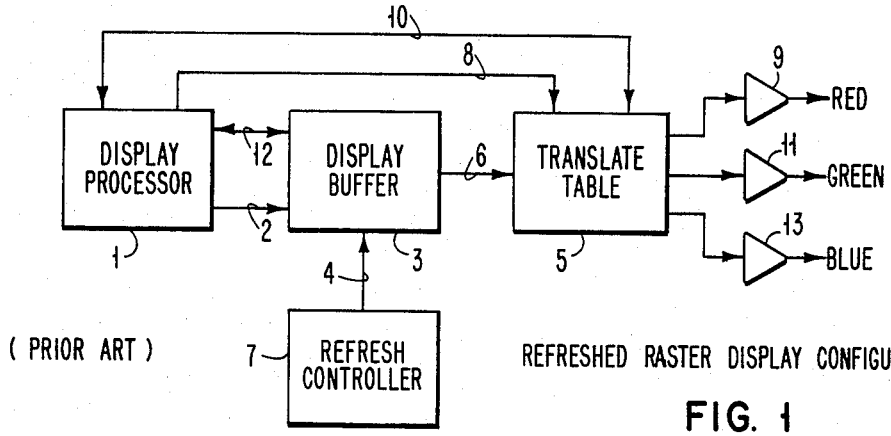
( PRIOR ART )
REFRESHED RASTER DISPLAY CONFIGURATION
FIG. 1
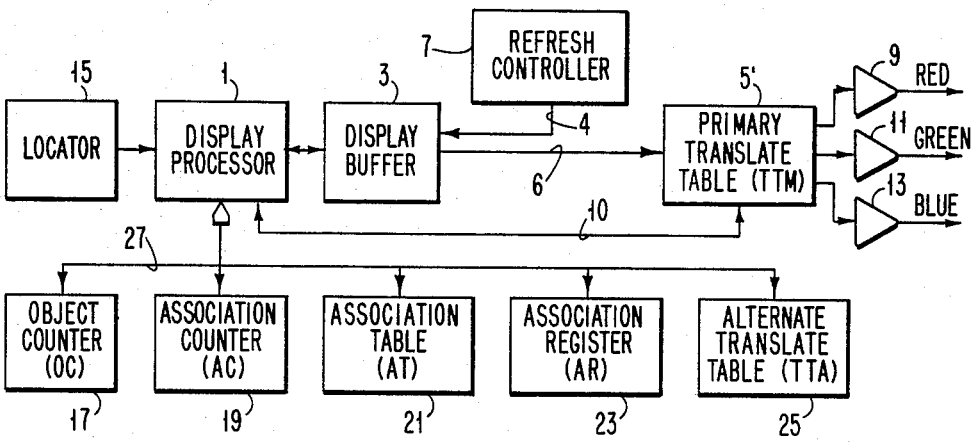
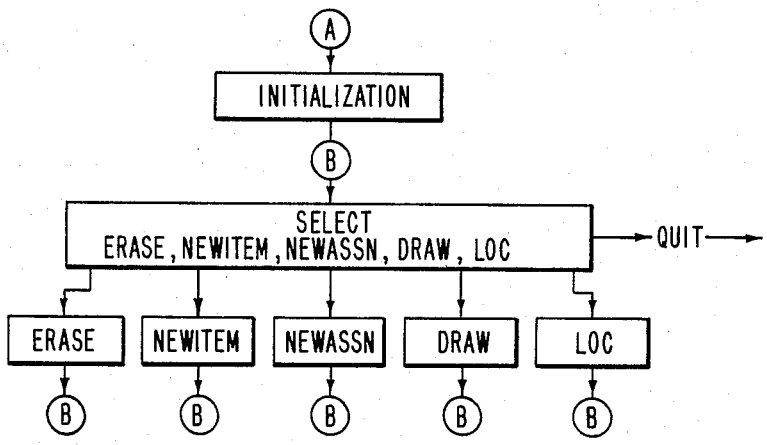
REAL CORRELATION/ECHO APPARATUS & INTERACTIVE CONTROL FLOW
FIG. 2

CORRELATE & ECHO FLOW OF CONTROL

```
PAT1: PROCEDURE OPTIONS (MAIN);
DCL L FIXED BIN (15);
DCL PB (16) FIXED BIN (15);
DCL OC FIXED BIN (15);
DCL AC FIXED BIN (15);
DCL AT (16) FIXED BIN (15);
DCL TTM (16) FIXED BIN (15);
DCL TTA (16) FIXED BIN (15);
DCL AR FIXED BIN (15);
DCL CMD CHAR (8);
DCL LOC FIXED BIN (15);
DCL (VAL1, VAL2) FIXED BIN (15);
DCL (I, K) FIXED BIN (15);

MAINLOOP: PUT SKIP EDIT ('LOC, NEWITEM, NEWASSN, DRAW, ERASE')(A);
GET EDIT (CMD) (A(8));
CMD = TRANSLATE(CMD,
  'ABCDEFGHIJKLMNOPQRSTUVWXYZ',
  'abcdefghijklmnopqrstuvwxyz');
SELECT (CMD);
  WHEN ('ERASE') DO;
    PB = 0;
    AC = 0;
    AT = 0;
    TTM = 0;
    TTA = 0;
    AR = 0;
    OC = 0;
    END;
  WHEN ('NEWITEM') DO;
    OC = OC + 1;
    IF OC > 16 THEN DO;
      OC = 16;
      PUT SKIP EDIT ('TOO MANY NEWITEMS, MUST ERASE') (A);
      END;
    AT(OC = AC;
    GET LIST (VAL1, VAL2);
    TTM(OC = VAL1;
    TTA(OC = VAL2;
    END;
  WHEN ('NEWASSN') DO;
    OC = OC + 1;
    AC = AC + 1;
    IF OC > 16 THEN DO;
       OC = 16;
       PUT SKIP EDIT ('TOO MANY NEWITEMS, MUST ERASE') (A);
       END;
```

FIG. 7A

```
    IF AC > 16 THEN DO;
       AC = 16;
       PUT SKIP EDIT ('TOO MANY NEWASSNS, MUST ERASE') (A);
       END;
    AT(OC = AC;
    GET LIST (VAL1, VAL2);
    TTM(OC = VAL1;
    TTA(OC = VAL2;
    END;
  WHEN ('DRAW') DO;
    GET LIST (LOC);
    IF LOC < 1 | LOC > 16
      THEN PUT SKIP EDIT ('ILLEGAL POSITION') (A);
      ELSE PB(LOC) =  OC;
    END;
  WHEN ('LOC') DO;
    GET LIST (LOC);
    IF LOC < 1 | LOC > 16
      THEN PUT SKIP EDIT ('ILLEGAL POSITION') (A);
      ELSE IF AT(PB(LOC)) ¬=AR
         THEN DO;
            DO I = 1 TO 16;
               IF AT(I) = AR
                  THEN DO;
                     K = TTM(I);
                     TTM(1) = TTA(I);
                     TTA(I) = K;
                     END;
                  ELSE IF AT(I) = AT(PB(LOC))
                     THEN DO;
                        K = TTM(I);
                        TTM(I) = TTA(I);
                        TTA(I) = K;
                        END;
               END;
            AR = AT(PB(LOC));
            END;
    END;
  WHEN ('QUIT')STOP;
  OTHERWISE DO;
    PUT SKIP EDIT ('OC, AC, AR, PB, AT, TTM, TTA',
                   OC, AC, AR, PB, AT, TTM, TTA)
                  (A, SKIP, 3(F(5)), SKIP 8(8(F(5)), SKIP));
    END;
  END;
  GO TO MAINLOOP;
END;
```

FIG. 7B

| OBJ. NO. | $M_M$ | $M_A$ | $M_B$ |
|---|---|---|---|
| 1 | 0 | 0 | 0 |

OBJECT 1 DRAWN IN A CLEARED BUFFER

| OBJ. NO. | $M_M$ | $M_A$ | $M_B$ |
|---|---|---|---|
| 1 | 0 | 0 | 0 |
| 2 | 0 | 0 | 0 |
| 3 | 0 | 2 | 1 |

OBJECT 2 DRAWN AFTER OBJECT 1

| OBJ. NO. | $M_M$ | $M_A$ | $M_B$ |
|---|---|---|---|
| 1 | 0 | 0 | 0 |
| 2 | 0 | 0 | 0 |
| 3 | 0 | 2 | 1 |
| 4 | 0 | 0 | 0 |
| 5 | 0 | 4 | 1 |
| 6 | 0 | 4 | 2 |
| 7 | 0 | 4 | 3 |

OBJECT 4 DRAWN AFTER OBJECTS 2 AND 1

| OBJ. NO. | $M_M$ | $M_A$ | $M_B$ |
|---|---|---|---|
| 1 | 1 | 0 | 0 |
| 2 | 0 | 0 | 0 |
| 3 | 0 | 2 | 1 |
| 4 | 0 | 0 | 0 |
| 5 | 0 | 4 | 1 |
| 6 | 0 | 4 | 2 |
| 7 | 0 | 4 | 3 |

ERASURE OF OBJECT 1

| OBJ. NO. | $M_M$ | $M_A$ | $M_B$ |
|---|---|---|---|
| 1 | 0 | 0 | 0 |
| 2 | 0 | 0 | 0 |
| 3 | 0 | 2 | 1 |
| 4 | 1 | 0 | 0 |
| 5 | 1 | 4 | 1 |
| 6 | 1 | 4 | 2 |
| 7 | 1 | 4 | 3 |

ERASURE OF OBJECT 4

"DRAW" - OBJECT MIXING

SELECTIVE ERASE

SELECTIVE ERASE MODIFIED

USE OF INVERSIONS IN THE NEAR REALTIME CONTROL OF SELECTED FUNCTIONS IN INTERACTIVE BUFFERED RASTER DISPLAYS

TECHNICAL FIELD

This invention relates to interactive buffered raster display systems, and more particularly to methods and means for improving editing at the control level in contrast to the list processing level in such systems.

BACKGROUND

Prior art interactive buffered raster displays include low persistance phosphor multiple gun color cathode ray tubes (CRTs). Such a CRT is the electronic medium upon which an image is painted by way of electron beam deflection and intensity modulation of its multiple color guns. Information, both defining the image to be painted and providing the necessary control, is obtained from a buffer intermediate the CRT display and a stored program controlled processor. The processor executes lists of graphical orders ultimately resulting in the CRT painted image. Among its tasks, the processor performs vector-to-raster conversion and causes bit values in the form of a multibit code to be stored in a counterpart location in the buffer. The multibit code, termed a "pixel", consists of an x,y position coordinate and a color number or value. As each pixel is extracted from the display buffer during a horizontal scan of a raster driven display, the bits are used to index a translate table which converts them into a larger number of bits. This larger number of bits, in turn, drives designated red, green and blue digital-to-analog converters actually modulating the multi-gun CRT beam intensities. Illustration may be found in Langdon, et al U.S. Pat. No. 4,255,861, issued Sept. 30, 1980. In this art, the purpose of the translate table is to minimize display refresh buffer size while maximizing the number of distinct displayable colors.

The display or graphic order list executed by the processor may consist of long instruction strings. At this level, editing of such strings involves reprocessing of the entire image and is considered computationally intense. For example, in prior art vector graphic systems, an editing function involving the correlation between display position coordinates of any light pen interrupt and the identity of a graphical object in the immediate vicinity requires rescanning of the display order list with multitudinous object/light pen position comparisons. Even a moderately complex display of 100 objects might require several hundred thousand orders with a significant number of comparisons. Although in correlation and echoing it was known to use a side file for reducing the computation by retaining the position coordinates of objects in a sorted order, this nevertheless still mandated a binary search for ascertaining the object identity given the light pen interrupt position. Relatedly, associative memories were used in the early 1970's in which position indexing of object identity was known. However, the several higher orders of magnitude cost of associative memory relative to RAM greatly diminished interest.

Stillman, 20 CACM, pp 331–339, May 1977; Newman, et al, "Principles of Interactive Computer Graphics", Second Edition, McGraw Hill, 1979 at pages 217–245 and 247–289; and Foley, "Fundamentals of Interactive Computer Graphics", Addison Wesley, 1982, at pages 123–136, 466–475 and 497–503, describe a raster graphic system responsive to a light pen interrupt which erases the display buffer and then reconstructs the image from an order list. Correlation is registered when the object being drawn by the execution of the order list had the same coordinates as the light pen position. Furthermore, these references describe dynamically changing color translation maps to achieve animation. Thus, the art teaches that because buffered raster displays do not dynamically process an order list but rather refresh the display from the stored raster image of a reprocessed order list, then editing must be performed at the display processor level.

THE INVENTION

It is object of this invention to devise methods and means for interactively executing one or more of the editing functions of correlation and echoing, selective erasure, and object mixing on a raster scanned image below the list or graphical order processing level. It is a related object that such processing enhancement be achieved with a minimum of hardware alteration to raster display systems.

The objects are satisfied by the use of the raster display buffer as an inverted index such that object identity is encoded in each pixel buffer position rather than color. Indeed, color information and other attributes of an object are furnished by auxiliary tables. Execution of editing functions such as echoing are attained by dynamically changing the auxiliary tables apart from the display buffer.

The conventional raster system includes a display buffer, a translate table, a display processor, and a refresh controller. To this is added a color look-up table. By creating and storing an inverted file of position-object identity pairs in the display buffer, then a light pen interrupt, for example, permits the display processor either to add the correlation to or obtain an object identity from the buffer. Editing functions such as echoing are implemented by the processor object identity indexing of the color look-up table. This table is a concordance between object identity and color attributes. The processor then uses the attribute to access and drive the color translate table and associated video output. Furthermore, the invention utilizes an invertible mixing function to uniquely encode the intersections of objects in the display buffer. This permits an entire object to be identified in the display buffer irrespective of whether said object has been overlayed in whole or in part by some other object or objects subsequently written into the display buffer.

BRIEF SUMMARY OF DRAWING

FIG. 1 discloses a buffered prior art raster graphic display system;

FIG. 2 depicts an interactive buffer raster display and a very high level interactive control flow diagram according to the invention;

FIG. 7 sets out a source code fragment for exercising a PL1 language processor to execute the correlate and echo flow of control function according to the invention.

DESCRIPTION OF THE PREFERRED EMBODIMENT AND INDUSTRIAL APPLICABILITY

Figure 3:
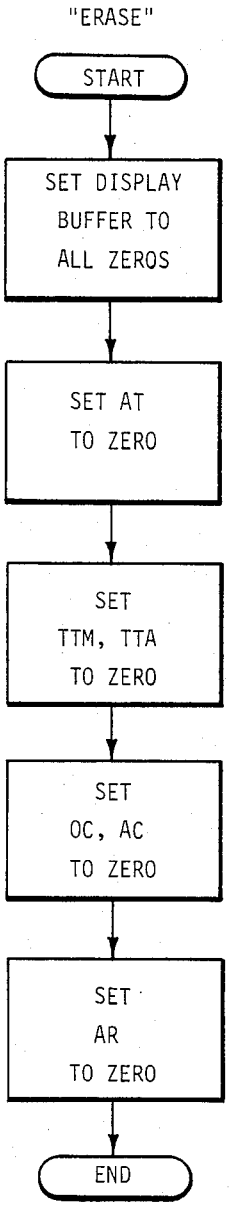
FIGS. 3–6 depict a detailed control flow for each of the selections identified in FIG. 2 for which FIG. 6 exemplifies the correlate and echo flow of control function.
Figure 4:
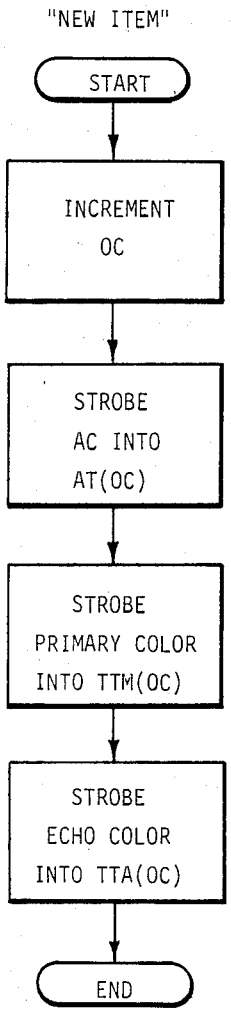
Figure 5:
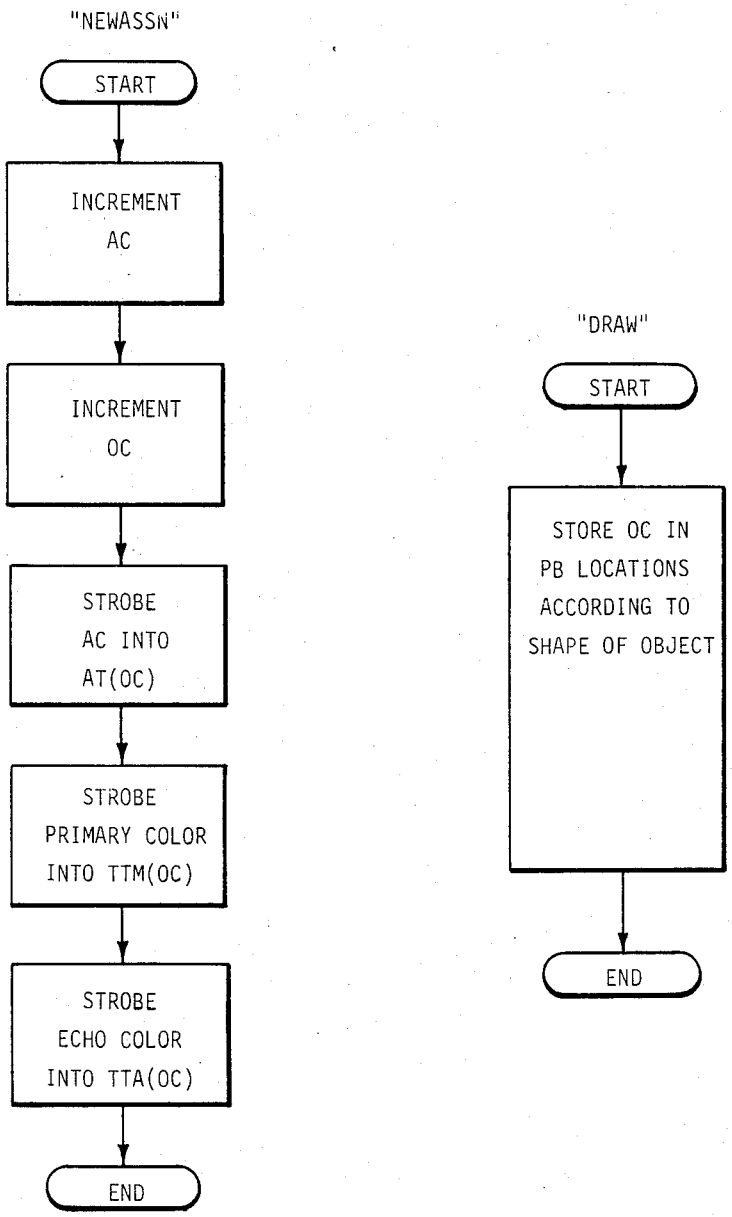

Referring to FIG. 1, there is shown a prior art refresh raster display configuration. A display processor which may be any CPU, such as an IBM system 370/3033, constructs an image of pixels and writes them into a display buffer 3 over paths 2 and 12. The display processor 1 also may access and alter the contents of the translation table over paths 8 and 10. Once the image is resident in buffer 3, it is normally cycled through the scan table and the video read head (not shown) as regulated by a refresh controller 7 over path 4. The refresh controller actually accesses the consecutive pixel locations in the display buffer. The color values of the extracted pixels are in turn converted by the translate table and applied to the red, green, and blue guns 9, 11 and 13 of the CRT respectively. The pixel x,y coordinates control the electron beam deflection.

In FIG. 2, there is shown an augmented configuration according to the invention. The augmentation includes a locator device 15 in the form of a light pen or joystick coupling processor 1, and several specialized counters and registers. These include an Object Counter 17 which assigns a unique integer identifier to each object which is displayed; an Association Register 23 which stores the identifier of the most recently correlated object; an Association Counter which assigns a unique integer identifier to each correlated object and position; an Association Table 21 consitituting some codence of objects and their color attributes; a Primary Translate Table 5' producing color values as indexed by an object identity; and an Alternate Translate Table 25 storing a color number defining the echoing color values also indexed by object identity. The registers and tables are accessible to display processor 1 over a busing path 27.

The interactive control flow shown in the lower portion of FIG. 2 is invoked to define a protocol of a typical editing function using the method of this invention. Here, the display processor, responsive to a function key actuation at a terminal, displays an editing menu for operator use. Selection of any one of these functions is further detailed in FIGS. 3–6. The program fragment in FIG. 7 supports the processing of any selection.

Referring now to FIG. 3, a typical sequence of operation is initiated with the erasure of the display buffer by setting the contents of each pixel location to a default value which is typically zero. The Association Table (AT), the Primary Translate Table (TTM) and the Alternate Translate Table (TTA) are also initialized to their default (zero) values. The Association Register (AR) as well as the Object Counter (OC) and Association Counters (AC) are reset.

A display order from processor 1 will define a new association and will designate a primary and echoing color for the first object in this association. In this regard, an association means the defining of an object by assigning to it one or more attributes such as color. At the same time, the Association and Object Counters are incremented, and the primary color value is moved into the Primary Translate Table indexed by the Object Counter. Likewise, the echoing color is moved into the Alternate Translate Table indexed by the Object Counter. Lastly, the Association Counter is moved into the Association Table indexed by the Object Counter. Finally, it should be observed that drawing display orders cause the display processor to restore the value of the Object Counter in appropriate locations of the display buffer. Display orders are those orders which, when executed, produce shapes in the form of storing values in the display buffer. In this invention it is the object identity.

As the refresh controller 7 scans out the contents of the display buffer 3, it uses the pixel values to index the TTM except when the pixel value is zero. For a pixel value of zero, the color beams controlled by elements 9, 11, and 13 are turned off. It follows that the primary color defined for shapes by the object or association under which these shapes were described is set out on the display. It is the purpose of association to permit correlation and echoing of a group of objects each of which may have a different color whenever any one of the objects is correlated.

Figure 6:
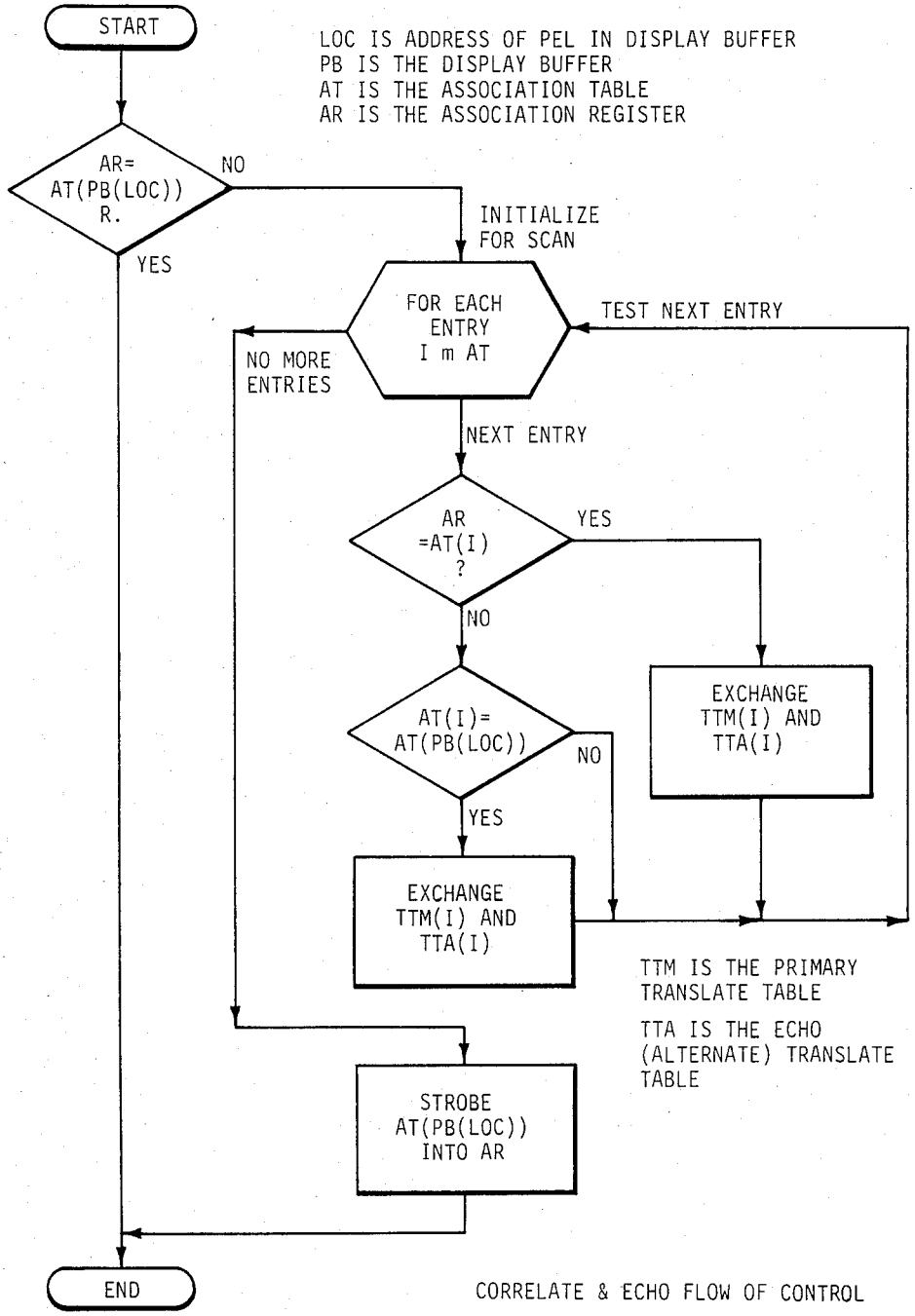

Referring now to FIG. 6, there is shown a flow of control of the correlation and echo function. When performing correlation and echoing, the display processor periodically receives its position from an external user control device such as a joystick or light pen. This position is then converted into an address of a pixel in the Display Buffer (DB). The value of the addressed pixel identifies an object. The association register holds the identity of the most recently correlated object. The object identifier from the display buffer is used to address the Association Table (AT), this value AT(DB-(LOC)) is compared with the value of AR. If these values are equal, the object currently being correlated is the same as the object which was previously correlated and no action is taken. However, if the values are not equal, then the contents of the Association Table are scanned. This is the process defined by the flow in the right hand portion of FIG. 6. This scanning involves comparing each entry in the Association Table with the value in the Association Register.

If a value is equal, then the corresponding entries TTM and TTA are exchanged. This causes the previously correlated objects to reappear in their designated primary colors, that is, the old echo is "turned off".

If an entry in the Association Table ATI is equal to a value in the table as indexed by the display buffer value, i.e., AT(TB(LOC)), then the corresponding entries in the TTM and TTA are exchanged. This causes newly correlated objects having the same color attributes to appear in their designated echo coloring. Finally, the AR is loaded with the value from the AT entry indexed by the display buffer value.

Referring now to FIG. 7, there is shown a program segment executable on a display processor capable of executing the PO1 objects code. The source code PO1 fragment defines a typical interactive protocol invokable by an operator. The program includes an initialization portion in which various registers and data types are declared and a main loop consisting primarily of an operator selectable n-way branch supporting the principal routines such as erase, new item, new association, and location heretofore described.

In the illustrative embodiment the declaration portion has arbitrarily confined the capacities of the display buffer, registers, and counters with respect to 16 pixel locations/objects. The expert skilled in this art would confront a typical limit two or three orders of magnitude greater in significance.

The segment is of single thread design. Note that at the beginning of the main loop a selection of functions is exhibited. The leftmost function "LOC" references correlation and echoing and is operator supplied by way of a light pen or joystick. The remaining functions "NEWITEM, NEWASSN, DRAW, ERASE" are obtained by way of a display order from the display file structure describing the object being exhibited. Technically, this line is called a prompt line. The first GET command enters the selection while the next command line translates the characters into upper case. The select command invokes the n-way branch. If the "ERASE" is selected, all registers and counters are set equal to zero. If NEWITEM is selected, this has the effect of defining the beginning of a new graphical scene. In this regard, the object counter (OC) is incremented. Also, a sentinel is inserted to avoid overflow of the OC. Next, AT (OC) is set at the current value of AC while the primary and secondary color values are currently entered in the TTM and TTA as indexed by OC. If a NEWASSN is invoked, it performs the same as NEWITEM but, additionally, increments AC. Relatedly, the DRAW function creates a pixel correlated with the object generated in NEWITEM.

The "LOC" function supports correlation and echoing. The test is whether a present correlated object has been previously correlated. No action results if the values are the same. However, if not equal, then AT is scanned by way of a new loop from I=12 to 16. Each entry is indexed by value I and compared. If the indexed entry is equal to the AR then the past echo is immediately turned off. If two or more correlated objects in AT are the same, then a new echo is turned on by way of swapping color table values between TTM and TTA. Note that the current correlation is recorded in AR by setting it equal to AT(DB(LOC)).

Although cancellation and echoing have been detailed, other editing functions incorporate the method of this invention. Among these are object mixing and selective erasure. Both take advantage of an invertible function computation, and the inverted file stored in the display buffer.

Two objects can be graphically "mixed". Illustratively, a blue object may overlay a yellow object to produce a green shade in the overlayed area. It is desired to identify the intersection of two objects. This is a necessary condition in order to implement an object oriented selected erase capability within which an object is erased and previously hidden objects are now seen again. Thus, in the example, if the blue object were erased, the "Mixed Area" would be restored to the yellow color.

If the object identifiers are considered to be points in a code space, then a method for accomplishing "mixing" utilizes a mixing function F(XY). F(X,Y) should be invertible. This means that given X, one can compute Y or given Y then X can be computed. When storing a new object in the display buffer, the object identifier is used, as for example the X value of the mixing function. If the contents of a location in the display buffer are zero, then no object is stored there by convention and the function F should be such that F(X,0)=X and F(0,Y)=Y. If the location in the display buffer is none (0), then an object is presently stored there and the display buffer value becomes the other input of the function (the Y value, for example). The result of applying the function then replaces the previously stored value in the display buffer.

Selective erasure of an object is accomplished by re-drawing the object and applying the left inverse of the mixing function in order to extract the previously stored object identifier value. Illustratively, if the object being erased is X, and the pixel value is Z, then the equation F(X,Y)=Z is solved for the value of Y, which replaces Z in the display buffer. It should be recognized that each function F is subject to the limitation that F(X,Y) is not the identifier of any graphical object. The mixing function F can be generated by either table definition which gives a complete description of the mapping performed by the function, or by algorithm. In a table implementation of F(X,Y) values, the table would be indexed by Z values. The left or right inverse would be found by indexing the table using the Z value and then extracting the X or Y value. Such a table would have the same magnitude as the object code space.

As applied to selective erasure, the left or right inverse of a function F can be computed. If the value is not an alias, then its inverse may be stored at the same time marking the pixel value and the left inverse value as unused object identifiers. If the value is an alias, then referencing the areas in the table in which it is stored, the value is stored from this table in the pixel, and a mark is made of both the original pixel value and the left inverse as unused object identifiers.

When a new joint object is created, an entry must be made in the color mapping table for F(X,Y) of the object. Likewise, when a joint object is erased, the color mapping table entry indexed by F(X,Y) must be reset to the background.

OBJECT MIXING AND SELECTIVE ERASURE EMBODIMENT

FIGS. 8–15 include flowcharts for the DRAW operation (FIG. 13) and for the ERASE operation (FIGS. 14 & 15) which applies to a particular object, as identified by its object number. The DRAW operation of FIG. 13 will replace the DRAW operation described in conjunction with the use of inversions to accomplish real-time correlation and echoing. The figures selectively exhibit the contents of the various important storage elements during drawing and erasure.

Object mixing and selective erasure are yet additional instances of the method of this invention. As before, the object identifier will be placed in the display buffer 3 for each pixel position occupied by an object per FIG. 8. However, where two objects would occupy a given pixel, a new object will be created, and an auxiliary tree structured linked list will relate this new object to the two objects which intersect, as shown in FIG. 9. The identifier of the new object will be stored in the display buffer at the appropriate position. The tree structured linked list may be used at any time to retrieve the identifier of either of the two objects which intersect at some given pixel position in the display buffer.

Figure 11:
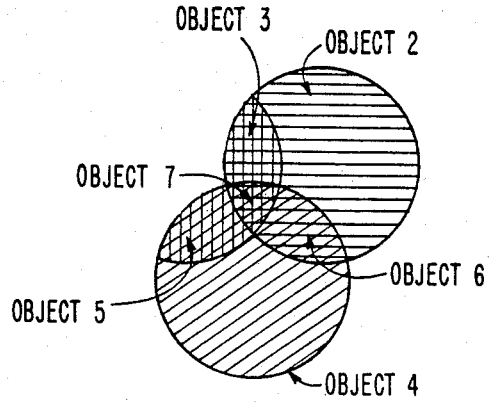
Figure 12:
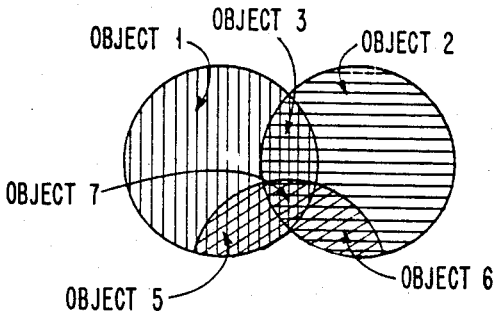
FIG. 12 sets out a multiple overlapped mixed object and its counterpart linked list used in selective erasure.

In the erasure of an object as depicted in FIGS. 11 and 12, each pixel position in the display buffer which would be occupied by the object is examined. The method for generating these pixel positions will be identical to the method which was originally used to draw the object. In the examination of a value in the display buffer, three cases arise:

1. The object does not intersect with any other drawn object.
2. The object intersects with another object, which latter object was drawn at some time after the object being erased.
3. The object intersects with another object, which latter object was drawn prior to the object which is being erased.

The method provides for behavior appropriate to each of these three cases.

In the first case, since no other object intersects, the erased object pixel may be removed from the display buffer by placing a "0" in the pixel location. In the second case, the display buffer is not modified, but the erased object is marked as erased in a fashion which is described below. In the third case, the erased object being the most recently drawn, the display buffer pixel may be restored to the value which it held before the erased object was drawn.

The following description of the method of drawing and erasure is given as an example. Several different techniques for the storage of the tree structured linked list might be used, as well as several techniques for processing this list, including the use of so-called "lookaside buffers" to enhance the processing speed of the method.

In this example, the tree structured linked list which records the intersections of objects will be shown as a table of three columns in FIGS. 8–12. The row index of this table corresponds to an object identifier. The first column, titled Mm, will contain a "1" when the object has been erased, and a "0" when the object is not erased. The second column, labeled Ma, will contain the identifier of the object most recently drawn, when the row index corresponds to an object which was created as the result of an intersection. For other objects, not created because of an intersection, this column will contain "0". The third column, labeled Mb, will contain the object identifier of the least recently drawn of the two objects when the row intersection corresponds to an object created as the result of an intersection. That is, Mb designates the first (oldest) object which intersects the row object. Otherwise, it will contain the value "0". One may thus conclude that an object whose Ma and Mb entries in this table are both "0" is not the result of an intersection. One may also conclude that an object whose Ma and Mb entries are other than "0" is an object created as the result of an intersection.

Figure 13:
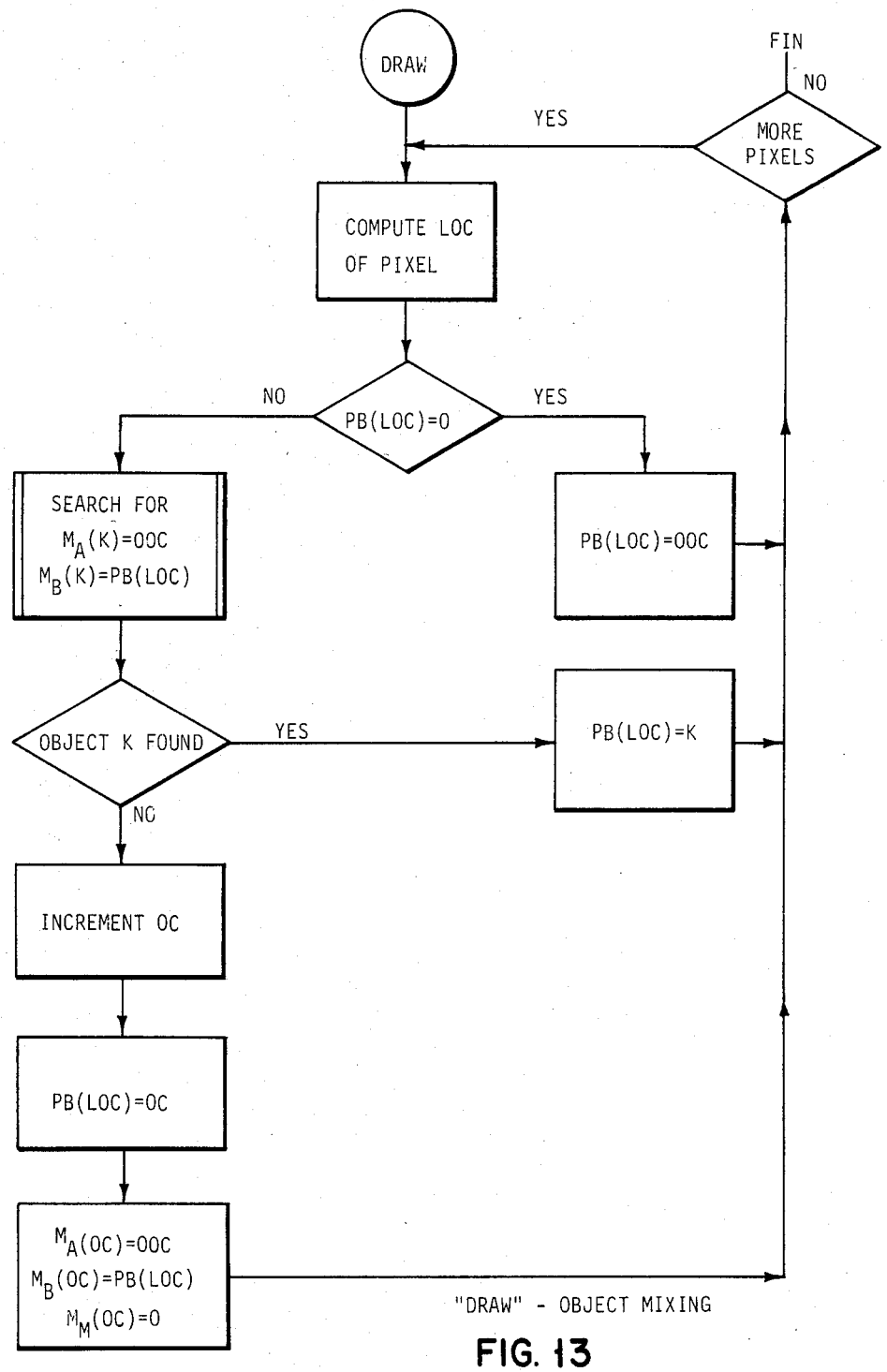
FIGS. 13–15 are a flow diagram depiction of mixing and selective erasure, respectively.

The flow diagram for the DRAW operation set out in FIG. 13 consists of an encompassing loop, which is repeated for each pixel position that would be occupied by the object being drawn. After generating a position (LOC), the contents of the display buffer at that position are examined, and a decision is made according to whether the contents are "0" or other than "0". If "0", then the position is presently unoccupied by any object, and so the identifier of the current object (OOC) is placed in the display buffer. If other than "0", then the position is already occupied by another object.

Two cases arise. First, the object that is occupying the pixel position has not yet been encountered in the drawing of the current object. Second, the object occupying the pixel position has been previously encountered. This case is determined by a search of the table mentioned previously. Here, "lookaside tables" may be employed to speed up this search.

As set out in FIG. 13, if the occupying object has not been encountered, then the object counter (OC) is incremented to create a new object. A new entry is made in the table, in which Mm is set to "0" to indicate that this new object is not erased. Ma of the new entry is set to the identifier of the currently drawn object (OOC). Mb of the new entry is set to the identifier of the previously drawn object, which value is obtained directly from the display buffer.

As further set out in FIG. 13, if the occupying object has been encountered in the drawing of the current object, then a row of the table will contain values for Ma and Mb such that Ma is equal to 00C, and Mb is equal to the value found in the display buffer. The index of this row is the identifier of the object which was created to represent the intersection of these two objects, and this row index is consequently stored in the display buffer.

Figure 8:
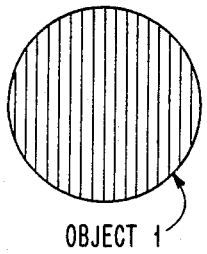
FIGS. 8–11 illustrate object mixing and its linked list mixing function representation as opaque objects of dissimilar colors are overlapped.
Figure 9:
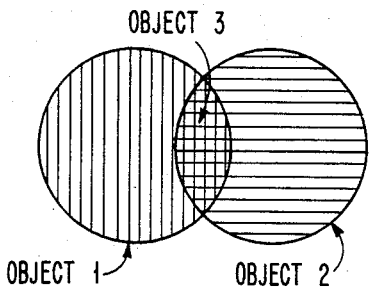

Turning attention to FIG. 8, there is shown a circular object drawn into a cleared display buffer. The row entry in the table will have been created by the NEWITEM operation. As this is a trivial modification to the NEWITEM operation whose flow diagram is given previously, it is not shown here. All pixel positions of the display buffer which are occupied by this circle contain the object identifier "1".

Figure 10:
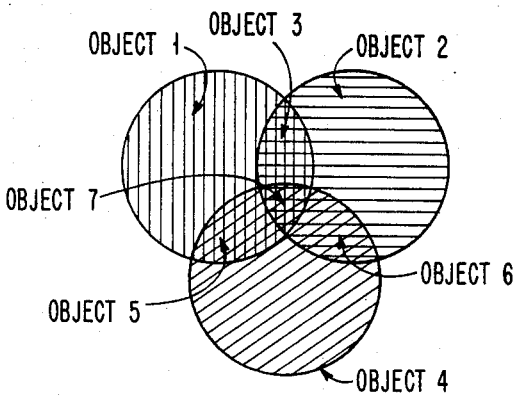

Referring now to FIG. 9, there is shown a second circular object which is drawn after the preceding object. The pixels in the cross-hatched area are the intersection pixels of objects "2" and "1", and a new object, whose identifier is "3" is created and the value "3" is stored in these pixel locations in the display buffer. FIG. 10 shows the result of drawing a third circular object, which intersects with each of the preceding three objects (that is, Object "1", Object "2", and Object "3", which is the intersection of Objects "1" and "2").

Figure 14:
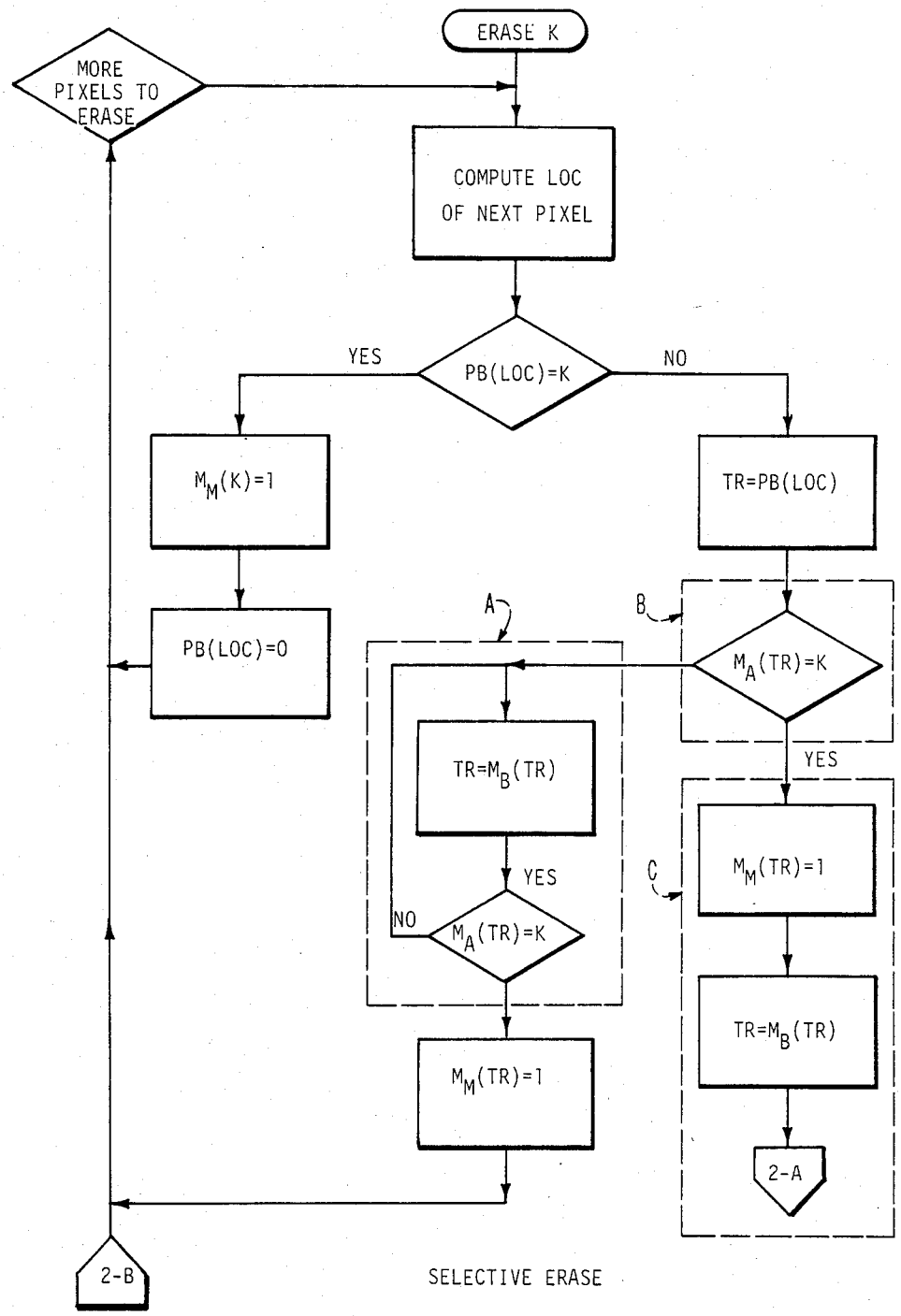
Figure 15:
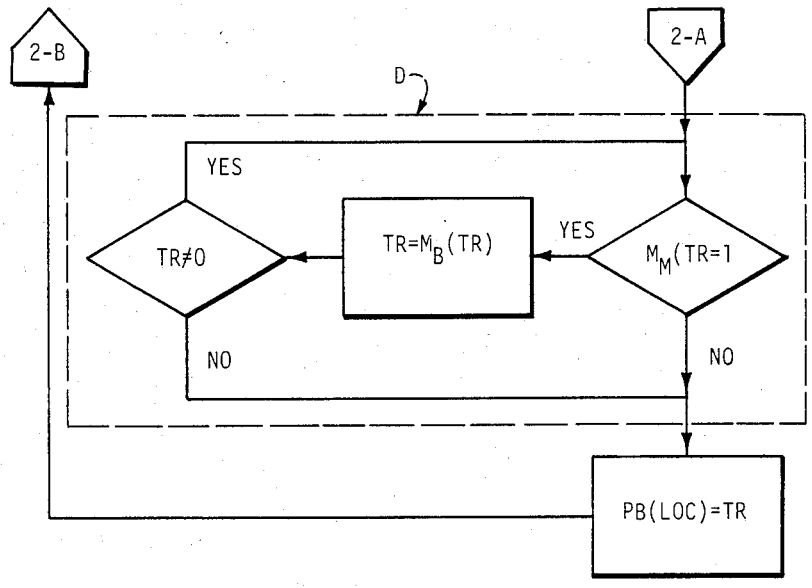

Selective Erasure of an object is shown in a flow diagram of FIGS. 14 and 15. As with DRAW, this method comprises a large loop which successively generates the positions (LOC) of each pixel which would be generated when drawing the object. The name K designates the object identifier of the object to be erased. Prior to beginning this loop, the object K is marked as erased, by setting the Mm entry in the table to the value "1". The value in the display buffer is examined. If equal to K, then the pixel position is unoccupied by any other object, and it may be set to "0", indicating that no object occupies this pixel position. Otherwise, a temporary register (TR) is used to hold the value in the pixel buffer. This value will not be "0", and it will identify an intersection object.

If the Ma value of the object whose identifier is in TR is equal to the value of K, then the object being erased is the most recently drawn and the display buffer will be restored to a state as if the object was never drawn. Recall that the value of TR identifies an intersection object. This object is marked as erased, by setting Mm to "1", since the most recently drawn object of the two in the intersection is precisely the one which is being erased. TR is now set to the value of Mb, which is the identifier of the least recently drawn of the two objects in the intersection, and the flow diagram continues with the label "2-A" on the second page. In the loop which begins at this label, the least recently drawn object is tested to determine whether it is erased, and if so, the object which preceded it is tested. This testing continues until either an unerased object is encountered, in which case the display buffer is set to the identifier of the unerased object, or until TR becomes "0", in which case the value "0" is stored in the display buffer, and the diagram returns to the first page via label 2-B.

Examining the case in which the object being erased is not the most recent object in the intersection, the method searches back through the chain of intersection objects until the one is found in which the erased object is the most recently drawn. This intersection object is marked as erased by setting the Mm value to "1". The display buffer is not modified, as it is known that at least one more recently drawn object also occupies this pixel position. FIGS. 11 and 12 show the erasure of Objects 1 and 4 respectively from the case shown in FIG. 10.

Though not shown in the accompanying flow diagrams, it is evident that when an intersection object is created or marked as erased, suitable modification must be made to the color concordance table which associates each object with a primary and secondary color. This modification may be easily done in accordance with one of three principles:

1. The objects are"opaque" and an intersection object always takes the color of the more recently drawn object.
2. The intersection object always takes the color of the least recently drawn object.
3. The intersection object always takes on a color which depends on the colors of the two intersecting objects (color mixing).
4. The intersection object always takes on a color which depends on the identifiers of the two intersecting objects (as for example to distinguish intersection areas of masks used to fabricate integrated circuits on silicon).

It will be further understood by those skilled in this art that various changes in the form and details may be made therein without departing from the spirit and scope of the invention. For example, the invention permits rapid movements, and changes the shapes of objects by use of selective erasure and recreation of objects. Additionally, advantages are realized in display editing functions which are executable either more rapidly than those of the prior art or are susceptible to processing more complex displays, or both.

I claim:

1. A method for editing a display of multicolored objects exhibited by an interactive refresh buffer raster driven display system comprising the steps of:

(a) forming a first concordance of display position and object identity and storing said first concordance in the refresh buffer;

(b) forming a second concordance of object identity and color attributes and storing said second concordance in auxiliary memory;

(c) position selecting at least one display object and specifying an editing function; and (d) executing the editing function by way of dynamic alteration of those attributes in the second concordance accessed through the position selection and object identity of the first concordance.

2. A method according to claims 1 or 3, wherein the editing function comprises selective erasure by way of removal of one or more overlapping color objects of dissimilar values, and further wherein the second concordance includes a tree structured linked list, each list entry being indexed by the object identity in the order in which drawn, each list entry includes the object erasure status, and the identity of the most and least recently drawn objects overlapping of the object indexing the entry, and still further wherein:

the position selecting and function specifying step includes the designation of the object to be erased;

the editing function execution step of selective erasure includes:

ascertaining whether an erasable object intersects any other drawn object and, if so, whether such intersection is with an object drawn prior or subsequent to the drawing of the erasable object;

and in the alternative either:

(a) deleting the object identity from counterpart display position entries in the first concordance if there be no overlap between erasable and other drawn objects;

(b) marking the erasable object as being deleted in the status field of the list indexed by its object identity if there be overlap with a subsequently drawn object; or (c) restoring the identity in counterpart display position entries in the first concordance of the most recently drawn object as expressed in the status field of the list indexed by the erasable object if there be overlap with a previously drawn object.

3. A method according to claim 1, wherein the position selecting and function specifying step includes selecting a function from the function set consisting of correlation and echoing, object mixing, and selective erasure.

4. A method for correlating and echoing selective multicolored objects within a display exhibited by an interactive refresh buffer raster driven display system comprising the steps of:

(a) forming a first concordance of display position and object identity and storing said first concordance in the refresh buffer;

(b) forming a second concordance of object identity and color attributes and storing said second concordance in auxiliary memory, said color attributes includes primary, secondary, and currently displayed color values and correlation markings, if any;

(c) position selecting at least one display object and instantaneously marking said object; and (d) comparing the instantaneous and any previously recorded markings; upon detection of a noncorrespondence therebetween, turning off any previously initiated echo by assigning the primary to the currently displayed object color value, recording the instantaneous markings, and turning the new echo on by assigning a secondary to the currently displayed object color value; and upon detection of a correspondence therebetween, inhibiting change of the currently displayed object color value.

5. An apparatus for display editing comprising:

raster driven display means;

a buffer for storing a display position-object identity image;

a table of attributes indexed by object identity;

means for refreshing the raster display by reading the buffer content in serial order, ascertaining the counterpart attributes from the table and modulating the display means accordingly;

an intercoupling stored program controlled processor for executing graphical orders; and means for externally interrupting said processor and for position selecting at least one displayed object and for designating an editing function to be performed thereon.

6. A method for color mixing by specification of an object intersection and overlap of colored objects within a display exhibited by an interactive refresh buffer raster driven display system, comprising the steps of:

(a) forming a first concordance of display position and object identity, and storing said first concordance in the refresh buffer;

(b) forming a second concordance including a tree structured linked list, each list entry being indexed by object identity in the order in which drawn, each list entry including a primary, secondary, and currently displayed color value, an invertible color mixing function, and identification of overlapped objects, and storing said second concordance in auxiliary memory;

(c) position selecting at least one display object and instantaneously marking said object; and (d) accessing the first concordance to ascertain whether the location is empty or whether it is occupied by a previously drawn object—if unoccupied, the new object identity is written into that display buffer location—if occupied, accessing the second concordance indexed by the object identity obtained from the first concordance, upon the counterpart listing in the second concordance showing no overlap, assigning the currently displayed color value of said object to a value determined by a mixing function and the object primary color value; upon the counterpart listing in the second concordance showing overlap, inhibiting the change of the currently displayed color value.

7. A method for selective erasure of one or more overlapping color objects of dissimilar value within a display exhibited by an interactive refresh buffer raster-driven display system, comprising the steps of:

(a) forming a first concordance of display position and object identity, and storing said first concordance in the refresh buffer;

(b) forming and storing in auxiliary memory a second concordance obtained from a tree-structured linked list, each list entry being indexed by the object identity in the order in which drawn in the refresh buffer, each list entry includes the object erasure status, and the identity of the most and least recently drawn objects overlapping the object indexing the entry;

(c) position selecting at least one display object and instantaneously marking said object for erasure; and (d) ascertaining whether the marked erasable object intersects any other drawn object, and if so, whether such intersection is with an object drawn prior or subsequent to the drawing of the erasable object; and in the alternative either:

(1) deleting the object identity from the counterpart display position entries in the first concordance if there be no overlap between erasable and other drawn objects;

(2) marking the erasable object as being deleted in the status field of the list indexed by its object identity if there be overlap with a subsequently drawn object; or (3) restoring the identity in the counterpart display position entries in the first concordance of the most recently drawn object as expressed in the status field of the list indexed by the erasable object if there be overlap with a previously drawn object.

* * * * *